US005560440A

United States Patent [19]

Tibbitts

[11] Patent Number: 5,560,440

[45] Date of Patent: Oct. 1, 1996

[54] BIT FOR SUBTERRANEAN DRILLING FABRICATED FROM SEPARATELY-FORMED MAJOR COMPONENTS

[75] Inventor: Gordon A. Tibbitts, Salt Lake City, Utah

[73] Assignee: Baker Hughes Incorporated, Houston, Tex.

[21] Appl. No.: 335,080

[22] Filed: Nov. 7, 1994

Related U.S. Application Data

[63] Continuation-in-part of Ser. No. 17,150, Feb. 12, 1993, Pat. No. 5,361,859.

[51] Int. Cl.[6] ..... E21B 10/20; E21B 10/62

[52] U.S. Cl. ..... 175/384; 175/366; 175/286; 175/289; 175/434

[58] Field of Search ..... 175/412, 413, 175/434, 428, 432, 368, 369, 370, 342, 384, 366

[56] References Cited

U.S. PATENT DOCUMENTS

| | | | |
|---|---|---|---|
| 3,106,973 | 10/1963 | Christensen | 175/413 |
| 3,326,308 | 6/1967 | White | 175/413 |
| 3,463,256 | 8/1969 | White | 175/412 |
| 3,672,455 | 6/1972 | Foster | 175/412 |
| 3,760,894 | 9/1973 | Pitifer | 175/413 |
| 3,862,665 | 1/1975 | Wallace | 175/383 |
| 4,252,202 | 2/1981 | Purser et al. | 175/412 |
| 4,499,958 | 2/1985 | Radtke et al. | 175/413 X |
| 4,538,928 | 9/1985 | Muma | 175/369 X |
| 4,682,663 | 7/1987 | Daly et al. | 175/43 X |
| 4,733,735 | 3/1988 | Barr et al. | 175/417 X |
| 4,830,123 | 5/1989 | Daly et al. | 172/434 |
| 4,838,366 | 6/1989 | Jones | 175/413 X |
| 4,858,706 | 8/1989 | Lebourg | 175/434 |
| 4,884,477 | 12/1989 | Smith et al. | 76/108 A |
| 4,919,013 | 4/1990 | Smith et al. | 76/108.2 |
| 4,991,671 | 2/1991 | Pearce et al. | 175/369 |
| 5,090,491 | 2/1992 | Tibbitts et al. | 175/43 X |
| 5,099,934 | 3/1992 | Barr | 175/434 |
| 5,101,692 | 4/1992 | Simpson | 76/108.2 |
| 5,147,001 | 9/1992 | Chow et al. | 175/428 |
| 5,150,636 | 9/1992 | Hill | 76/108.2 |
| 5,439,068 | 8/1995 | Huffstutler et al. | 175/356 |

*Primary Examiner*—Stephen J. Novosad
*Attorney, Agent, or Firm*—Trask, Britt & Rossa

[57] ABSTRACT

A rotary bit for drilling subterranean formations. The bit includes a separately-fabricated bit body and cutter support structures, the latter of which may be designed as blades, ribs, pads or otherwise, depending upon the bit style. The body and one or more cutter support structures are assembled and secured together after fabrication. Separate fabrication of the cutter support structures permits more precise cutter positioning, as well as orientation, and promotes the use of stronger and more diverse cutter affixation means. The cutter support structures may be adjustably radially movable with respect to the bit body, so as to provide the ability to fabricate bits of various gage sizes within a range using a single bit body and single size of cutter support structure.

19 Claims, 13 Drawing Sheets

BIT FOR SUBTERRANEAN DRILLING FABRICATED FROM SEPARATELY-FORMED MAJOR COMPONENTS

This application is a continuation-in-part of application Ser. No. 08/017,150 filed Feb. 12, 1993, now U.S. Pat. No. 5,361,859.

BACKGROUND OF THE INVENTION

1. Field of the Invention

This invention relates generally to drill bits used in drilling subterranean wells or in core drilling of such wells. The invention relates specifically to drill bits having a variable effective diameter which facilitates placement of the drill bit downhole and retrieval thereof. The drill bit of the present invention is particularly suitable for passing through narrow spots in the wellbore, through sluffing spots and through casing to drill an expanded wellbore therebelow. The invention may also be employed in drill bits having replaceable blades or other cutter support structures.

2. State of the Art

Equipment for drilling into the earth is well-known and long established in the art. The basic equipment used in drilling generally includes a drill bit attached to the bottom-most of a string of drill pipe and may include a motor above the drill bit for effecting rotary drilling in lieu of or in addition to a rotary table or top drive on the surface. In conventional drilling procedures, a pilot hole for the setting of surface casing is drilled to initiate the well. A smaller drill bit is thereafter placed at the bottom of the pilot hole surface casing and is rotated to drill the remainder of the wellbore downwardly into the earth.

Many types and sizes of drill bits have been developed especially to accommodate the various types of drilling which are done (e.g., well drilling and coring). A drill bit typically comprises a body having a threaded pin connector at one end for securement to a drill collar or other drill pipe, a shank located below the pin, and a crown. The crown generally comprises that part of the bit which is fitted with cutting means to cut and/or grind the earth. The crown typically has portions designated as the chamfer (the portion below the shank which flares outwardly from the shank), the gage (the annular portion of the cutting means below the chamfer which is usually concentric with the shank), the flank (a tapered portion of the cutting means below the gage), and the nose (the bottom-most portion of the cutting means and that which acts upon the bottom of the hole).

Drill bits include cutting elements for cutting the earth. The two major categories of drill bits are diamond drag bits, which have small natural diamonds or planar or polyhedral synthetic diamonds secured to certain surfaces of the bit body, and roller cone bits, which typically comprise at least two rotatable cones having carbide or other cutting elements disposed on the surfaces thereof. From time to time, the cutting elements of any drill bit become dull and must be replaced or the bit itself replaced. During drilling operations, drilling fluid or mud is pumped down into the hole to facilitate drilling and to carry away formation cuttings which have been cut away by the cutting elements.

From time to time during drilling of a well, the drilling activity will stop for a number of reasons. For example, another length or joint of drill pipe must periodically be added to the drill string in order to continue drilling. At other times drilling will stop because the drill bit may become lodged or jammed downhole, or the drill bit will have become dulled and will need to be replaced. In response to any of these scenarios, the drill bit must be brought out of the hole to either diagnose the reason for the stoppage or to replace the old, worn cutting elements with new elements.

It frequently occurs that when a drill string is tripped or brought out of a hole, the bit will become jammed downhole because of an encounter with debris or with an irregularity in the wall of the hole. Jamming is particularly prevalent when the wellbore includes a non-vertical segment, either inadvertently or by design, such as during highly-deviated or horizontal drilling. In the former case, during drilling, the bit may wander or move temporarily from a strictly-vertical orientation, resulting in a hole which curves away from the vertical. A phenomenon of this type, particularly where the departure from the vertical is abrupt, may be known as a "dogleg." In the latter instance, the wellbore is caused to depart from the vertical by use of a whipstock or by directional or navigational drilling bottom hole assemblies. In both cases, because of the curvature of the hole, tripping a state of the art drill bit in or out of the hole is often time-consuming or even impossible, in the latter instance necessitating the severance of the drill string at the stuck point, retrieval thereof, setting of a whipstock and drilling a new hole around the remaining portion of the drill string and the bit at the end thereof.

In some instances, due to drill bit cutter damage or unusual formation characteristics, boreholes may be drilled which are "under gage" (i.e., having an undersize diameter in comparison to the design diameter or gage diameter of the drill bit), or out of round as well as under gage. Subsequent removal of the drill string and, in particular, the bit in such situations is difficult to effect.

Thus, it would be an improvement in the art to provide a drill bit which includes cutting means which are variably positionable to expand to full or design gage while downhole and in an operative drilling mode and to retract when raised in the hole to facilitate tripping the drill bit in and out of the hole.

It would also be an improvement to provide a drill bit which will pass through a smaller diameter wellbore or casing and drill a larger, expanded diameter hole therebelow.

Expandable cutting means associated with drilling equipment have been known for many years, but such expandable cutting means have been directed to solving other problems encountered in drilling procedures. For example, expandable cutters attached to a drilling sub and located intermediate to the drill string have been used as apparatus to underream previously-drilled holes. Underreaming is a procedure well-known in the drilling industry to enlarge a portion of a previously-drilled hole below a point of restriction. Thus, underreaming apparatus are used to enlarge holes below a casing in order to place the next length of casing (see, e.g., U.S. Pat. No. 1,944,556 to Halliday, et al.; U.S. Pat. No. 2,809,016 to Kammerer; U.S. Pat. No. 4,589,504 to Simpson) or to enlarge a previously-drilled pilot hole in preparation for insertion of explosives therein (see, e.g., U.S. Pat. No. 4,354,559 to Johnson; U.S. Pat. No. 3,817,339 to Furse).

Drill bit assemblies directed to drilling a wellbore have been designed in which the cutting means grind out a diameter exceeding the diameter of the drill bit body or drill string. For example, in U.S. Pat. No. 1,468,509 to Overman, a wedge-shaped drill bit has corresponding slips which dovetail with the drill bit so that when the bit is lowered to the bottom, the slips slide upwardly to come into complementary registration with the body of the drill bit. Drill rollers designed to finely-crush or comminute the material in the bottom of the hole are positioned at a slight angle to a central longitudinal bore so that as the rollers turn, they drill out a diameter of earth slightly larger than the diameter of the drill bit. The rollers of Overman, however, do not expand outwardly from a vertical axis to achieve a diameter significantly in excess of that of the drill bit. Further, the elongated design of the Overman device would be disadvantageous in curved well conditions.

In U.S. Pat. No. 1,838,467 to Stokes, a drill bit assembly includes two cutter blades positioned within a bit head, both cutter blades moving from a retracted position within the bit head to an expanded position relative to the bit head when a spring biased plunger is forced downwardly to engage the cutter blades. Upward motion on the bit carrier housed within the bit head urges the plunger upwardly to move the cutter blades into a retracted position for tripping out of the hole.

Expandable cutter means in the prior art have not been specifically developed to facilitate easy removal of the drill bit from a hole, particularly under special drilling conditions such as non-vertical or curved holes. Therefore, it would be an improvement in the an to provide cutting means associated with a drill bit which are appropriately expandable and retractable under all drilling conditions and which do not require complex subassemblies within the bit head.

SUMMARY OF THE INVENTION

A drill bit is provided which has a body and cutting means associated therewith which move between a first position effecting a smaller diameter relative to the diameter of the body and a second position effecting a larger diameter relative to the diameter of the body, the larger diameter comprising the effective gage of the drill bit. The movable cutting means advance from the first, retracted position to the second, expanded position as a result of pressure applied to the bottom or leading end of the cutting means. Such pressure is provided by the weight of the drill string or by a mechanism used to advance the drill string in the hole (common in horizontal drilling) when the drill bit is placed downhole and the movable cutting means come to rest on the bottom of the hole. When the drill bit is raised, the movable cutting means retract from the second position to the first position, thereby effecting a gage diameter equal to or smaller than the bit body to facilitate removal of the drill bit from the hole.

The body of the present invention is structured to retain the movable cutting means in slidable association therewith. Particularly-suitable structure of the body includes the formation of channels in the face of the body sized to receive a portion of the movable cutting means therein to facilitate slidable movement of the cutting means relative to the body.

The outer configuration of the body is adapted to facilitate movement of the cutting means from a first position effecting a smaller diameter to a second, expanded position effecting a larger diameter. A particularly-suitable configuration for the body is one generally having a conical shape with a top portion having a diameter approximately equal to or slightly larger than that of the drill pipe and a lower portion tapered toward the nose of the drill bit.

The cutting means may be of any suitable size, shape or dimension provided that the cutting means are movable, relative to the body, to effect a gage diameter greater than that of the drill pipe. One suitable configuration for the cutting means of the invention is a blade or wing. The cutting means may preferably include a portion thereof which is slidably disposable within a channel formed in the body of the drill bit. The cutting means further includes cutting elements which may be either conventional carbide teeth, natural or synthetic diamonds of any configuration, or other suitable cutting elements known in the art.

The drill bit of the present invention may be used in connection with both well drilling and core drilling. When used in connection with well drilling, the body further includes secondary cutting means which are secured to the bottom of the body and centered with the longitudinal axis of the drill bit. The secondary cutting means is configured to allow unobstructed movement of the movable cutting means between the first and second position. The secondary cutting means include cutting elements which may be carbide teeth, diamonds or other suitable curing elements known in the art. When the drill bit of the present invention is used in connection with core drilling, the movable cutting means are positioned about a central opening in the nose at the bottom of the body which allows the cut core to enter into the inner bore of a core barrel above the bit.

It is also contemplated that the drill bit design of the present invention may be employed in a drill bit having slidably-insertable or otherwise-shaped blades, wings, ribs or pads which are prefabricated and have cutters secured thereto, which structures are then fixed to the bit body, and which may subsequently be removed therefrom for repair or replacement. It is also contemplated that this embodiment of the invention affords the ability to fabricate bits of various diameters within certain size or gage ranges by adjusting the position of the blades with respect to the bit body prior to affixation thereto.

The present invention has equal applicability to fixed cutter or rotary drag bits and to roller cone bits.

BRIEF DESCRIPTION OF THE DRAWINGS

In the drawings, which illustrate what is currently considered to be the best mode for carrying out the invention.

DETAILED DESCRIPTION OF THE PREFERRED EMBODIMENTS

Figure 1:
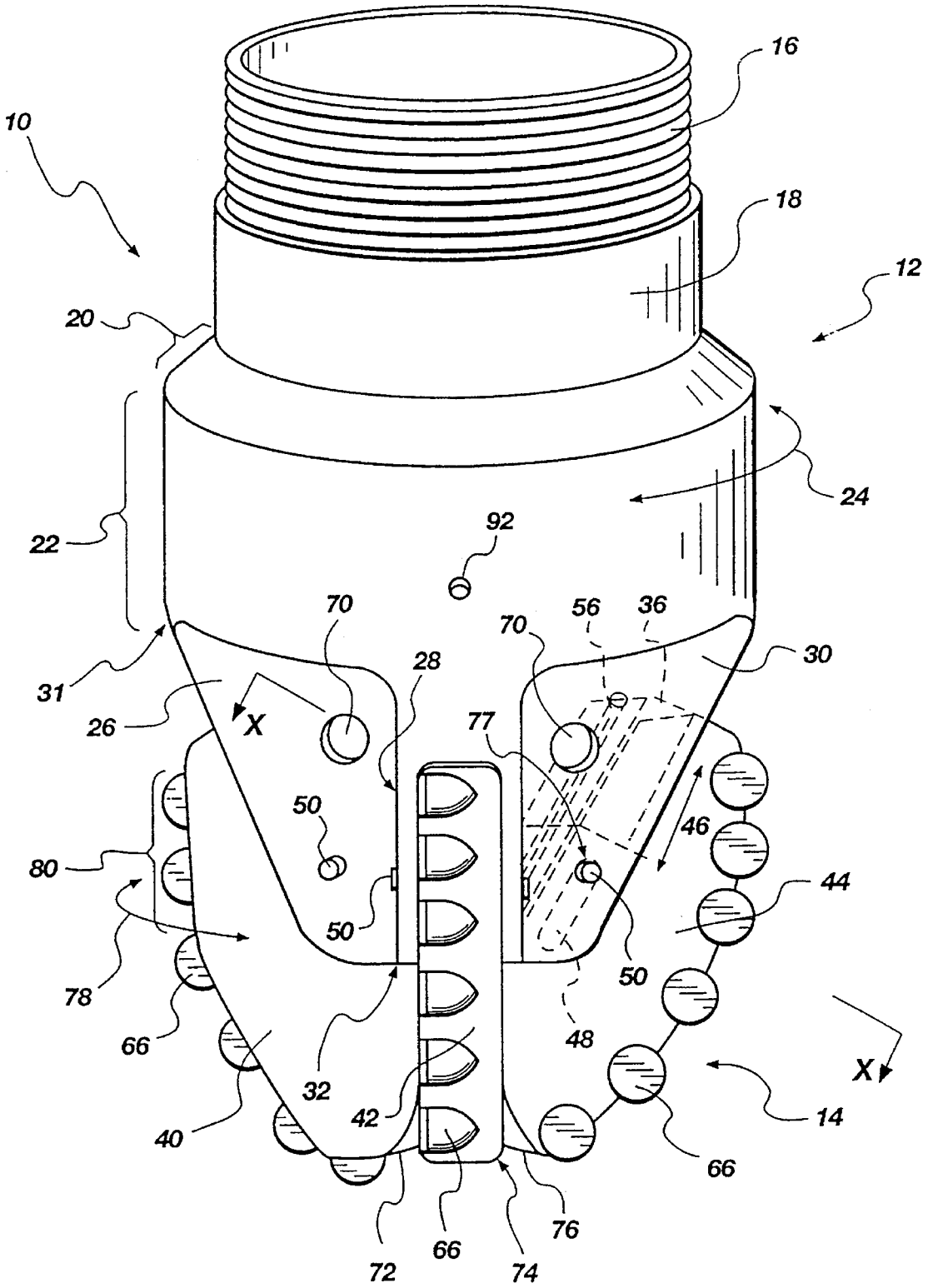
FIG. 1 is an elevational view of a first preferred embodiment of the drill bit of the invention illustrating the cutting means in the first position.

A first preferred embodiment of the drill bit of the present invention, generally indicated by reference numeral 10 in FIG. 1, includes a body 12 and cutting means 14 associated therewith. The drill bit is attachable to the downhole end of conventional drilling apparatus (not shown) such as a string of drill pipe, drill collar or other drilling sub element, including without limitation the output shaft of a downhole motor. The drill bit 10 may be attached to the drilling apparatus by means of a threaded pin connector 16. Below the pin connector 16 is the shank 18 of the drill bit 10, and below the shank 18 is the chamfer 20.

The outer body diameter 22 of the drill bit 10 generally defines the outermost circumference 24 of bit body 12, which in conventional bits would also define the gage of the bit. However, in the drill bit 10 of the present invention, the bit body 12 is structured to permit variable positioning of movable cutting means 14 between a first, retracted and a second, expanded position, the former in most cases defining a diameter no larger than that of bit body 12, while the latter defines a substantially larger diameter. The second, expanded position of cutting means 14 defines the gage or working diameter of the bit 10 of the present invention. The bit body 12 may preferably be structured to taper inwardly (see FIG. 1) from the outer body diameter 22; the inward taper, in combination with the cutting means 14 in the retracted position, facilitates lowering the drill bit into the hole, a process commonly known as "tripping in," and facilitates removal of the drill bit from the hole, a process commonly known as "tripping out."

In one exemplary embodiment illustrated by FIG. 1, the bit body 12 is configured with three columns 26, 28, 30, each of which serves to support cutting means 14. The columns 26, 28, 30 extend from the bottom edge 31 of the outer body diameter 22 to the nose 32 of the bit body 12 and are tapered inwardly from the outer body diameter 22 to the nose 32. Each column 26, 28, 30 has formed therethrough a channel 36, shown in phantom, in which a portion of the cutting means 14, designated as blades or wings 40, 42, 44, is slidably positioned.

As suggested in phantom line by FIG. 1, the blade 44 may move upwardly and downwardly in the channel 36 in the directions shown at 46. Blades 40 and 42 are similarly movable in cooperating channels. As further suggested in phantom line by FIG. 1, each blade (44 serving as an example) has a slot 48 formed through the thickness thereof and a positioning pin 50, inserted laterally through each column 26, 28, 30 fits within the slot 48 of the blade. Each blade 40, 42, 44 is therefore maintained within its respective channel by the pin 50. The movement of each blade 40, 42, 44 in its respective channel 36 is dictated by the traverse of the pin 50 in the slot 48. It will, of course, be understood that bit body 12, and specifically columns 26, 28 and 30, may be slotted instead of blades 40, 42 and 44, the latter carrying pins to cooperate with the slotted columns.

Figure 2:
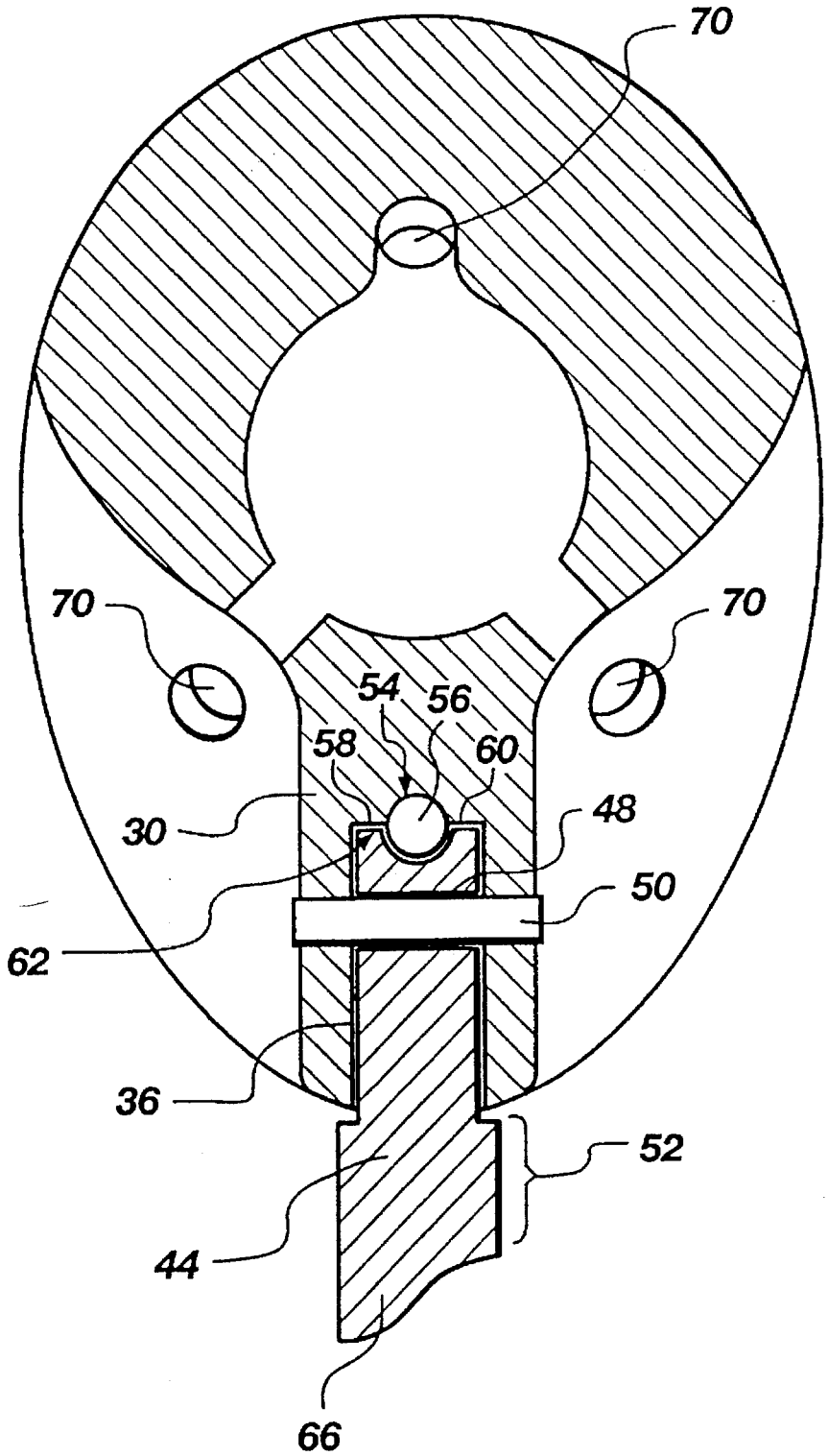
FIG. 2 is a view in cross section of the drill bit taken at line X—X of FIG. 1.

The relationship of the blade 44, channel 36, slot 48 and pin 50 may be more completely understood by reference to FIG. 2, which illustrates a cross section of the bit body 12 of FIG. 1 taken at line X—X thereof. It can be seen that pin 50 extends laterally through the column 30 and through the slot 48 formed through the blade 44. It may also be seen that the portion 52 of the blade 44 which extends outwardly from the column 30 may be slightly broader than the portion of the blade 44 which is positioned within the channel 36. This configuration of the blade 44 helps prevent debris from entering channel 36.

Bearing means 54 may be associated with each channel 36 to facilitate movement of the blade 44 therewithin. As illustrated by FIG. 2, the bearing means 54 may be a cylindrical rod 56 formed or secured in the bottom 58 of the channel 36 which cooperates with a reciprocating race 60 formed along the inward face 62 of the blade 44. Thus, as the blade 44 slides within the channel 36, race 60 of the blade 44 slides over rod 56 to provide ease of movement. Alternatively, rod 56 may be replaced by a plurality of balls, either closely or loosely placed in a race or groove in body 12.

The cutting means 14 of the drill bit 10 may be sized and configured in any manner which provides an appropriate cutting profile. By way of illustration, the blades 40, 42, 44, shown by FIG. 1, may be disk-like, having a portion positioned within a channel of the bit body 12 and a portion which extends away from the bit body 12. The portion which extends outwardly from the bit body 12 has cutting elements 66 associated therewith, such as carbide bits shown in FIG. 1. The type of cutting element 66 used in connection with the cutting means 14 may be any of the conventional types known in the art, such as natural or synthetic diamonds, and the like. What material of cutting element 66 is optimal for use, and the configuration of the cutting means 14, is determined by the type of drilling desired and the particular characteristics of the earth formation being drilled. It is preferable that the cutting elements 66 be fixed to rather than movable (rotating) with respect to the blades.

The drill bit of the present invention may also include apertures 70 formed through the bit body 12 to provide passage of drilling fluid, or mud, to the face of the cutting means 14. That is, drilling fluid is typically pumped downwardly through the drill pipe into passages or a central plenum in bit body 12 and exits through apertures 70, commonly known as nozzles. The apertures 70 are formed in the bit body 12 at an angle which specifically trains a jet of fluid to the face and cutting elements 66 of each blade to keep debris from becoming lodged against or between the cutting elements 66, to cool the cutting elements 66 and to remove debris from the bottom of the wellbore and up the exterior of the drill string.

As illustrated, the drill bit 10 of the present invention provides movable cutting means 14 which are movable from a first retracted position, effecting a diameter resulting in a circumference 78 defined by rotation of the cutting means 14, which is equal to or less than the diameter and circumference 24 of the outer diameter 22 of the body 12 of drill bit 10 (see FIG. 1), to a second expanded position effecting a diameter resulting in circumference 78; which is greater than the circumference 24 of the outer diameter 22 of body 12 (see FIG. 3) and which defines the working gage of drill bit 10 when drilling. As illustrated by FIG. 1, when the drill bit 10 is being tripped in or out of the hole, gravity and drag on the wellbore wall acts upon the blades 40, 42, 44 to draw the blades downwardly. In being drawn downwardly, the lower edges 72, 74, 76 of the blades 40, 42, 44 converge together, and each blade is suspended within its respective channel by registration of the pins 50 against the upper end 77 of each corresponding slot 48 and by mutual contact at the nose of the bit.

When the drill bit 10 is being tripped in or out of the hole, and thus the blades 40, 42, 44 are drawn downwardly, the circumferential distance 78 around the outer gage portion 80 of blades 40, 42, 44 is equal to or less than the circumferential distance 24 around the outer body diameter 22 of the drill bit 10. Comparison of the outer body diameter 22 of the drill bit 10 to the outer extent 80 of the blades during tripping may be seen in FIG. 4, which illustrates a cross section of blade 44 shown in FIG. 7. Because the blades are retracted when the drill bit 10 is travelling through the hole, the blades 40, 42, 44 cannot easily become lodged on any material or formation in the hole and cannot become jammed downhole.

Figure 3:
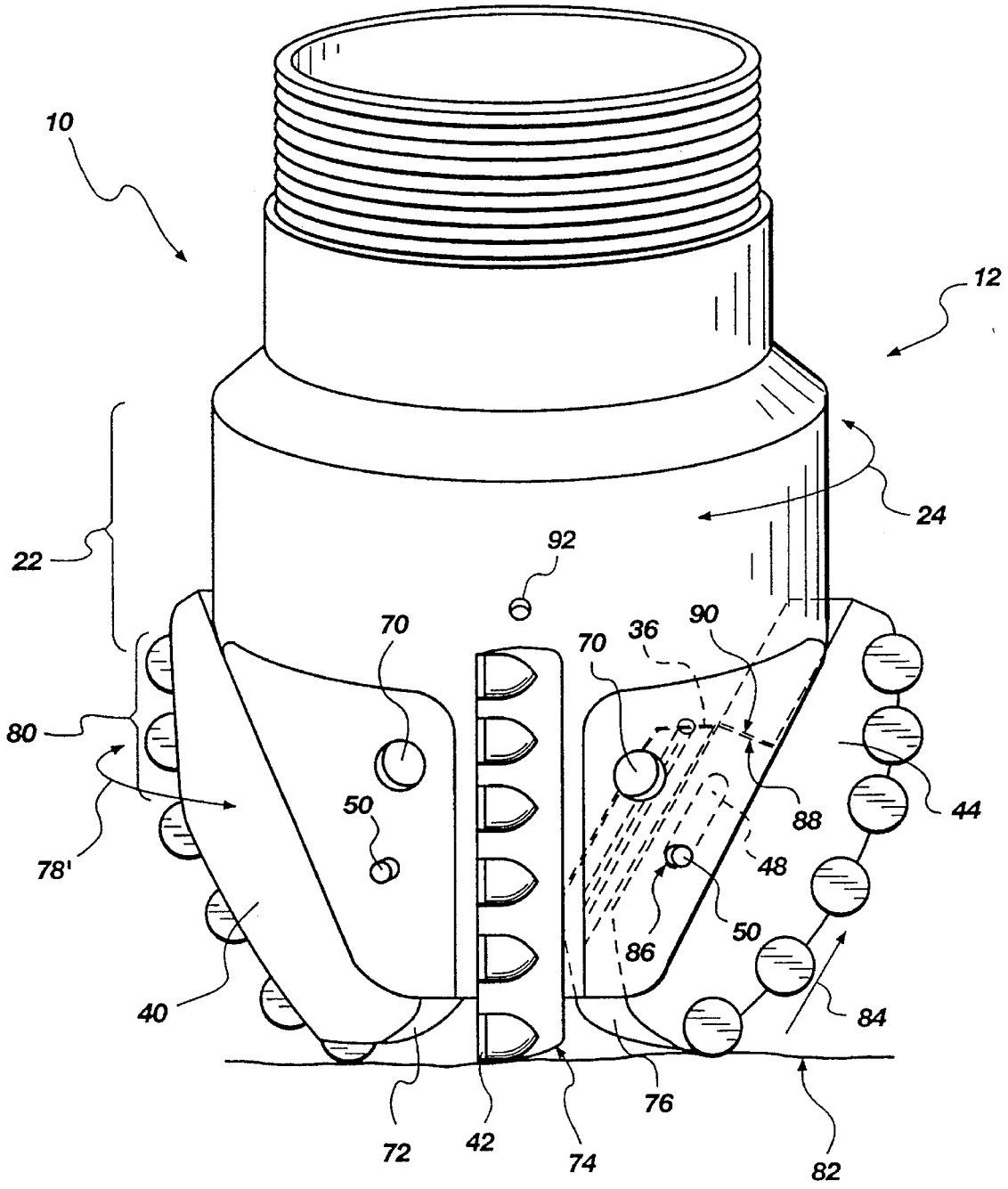
FIG. 3 is an elevational view of the drill bit illustrating the cutting means in the second, expanded position.

As shown in FIG. 3, when the drill bit 10 is tripped into the hole, the lower edges 72, 74, 76 of the blades 40, 42, 44 eventually come into contact with the bottom of the hole 82. Contact of the blades 40, 42, 44 with the bottom of the hole 82 results in force being applied to the lower edges 72, 74, 76 of the blades 40, 42, 44 and the blades are urged upwardly and radially outwardly in direction 84 until each pin 50 comes into a position proximate the lower end 86 of each slot 48. At the same time, the upper edge 88 of the blade 44 positioned within the channel 36 comes into registration with the upper end 90 of the channel 36, thereby preventing further upward and outward movement of the blade 44 in the channel 36 and shearing of pin 50. The relationship of the blade 44 to the channel 36 may be more easily understood by reference to FIG. 5.

While the drill bit 10 of the present invention is illustrated as having a retracted position wherein the cutting means 14 define a diameter which is less than outer diameter 22 of body 12, it should be understood that the retracted cutting means 14 may initially define a larger diameter than body 12 and extend even farther radially outwardly from body 12 in an expanded position.

Figure 4:
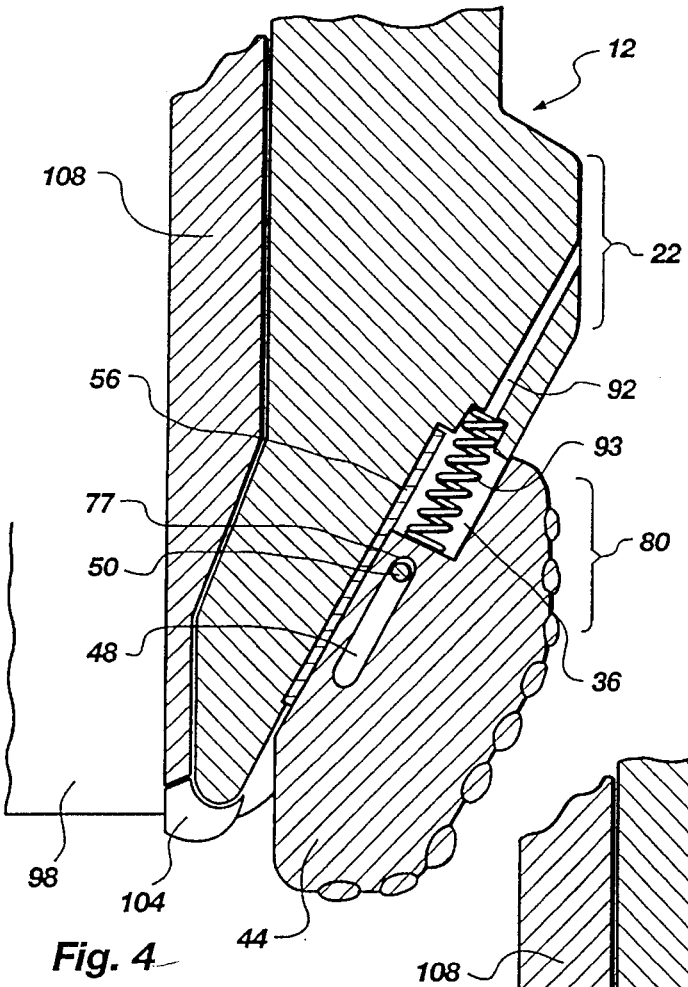
FIG. 4 is a partial view of a core bit in cross section illustrating the cutting means in the first position.
Figure 5:
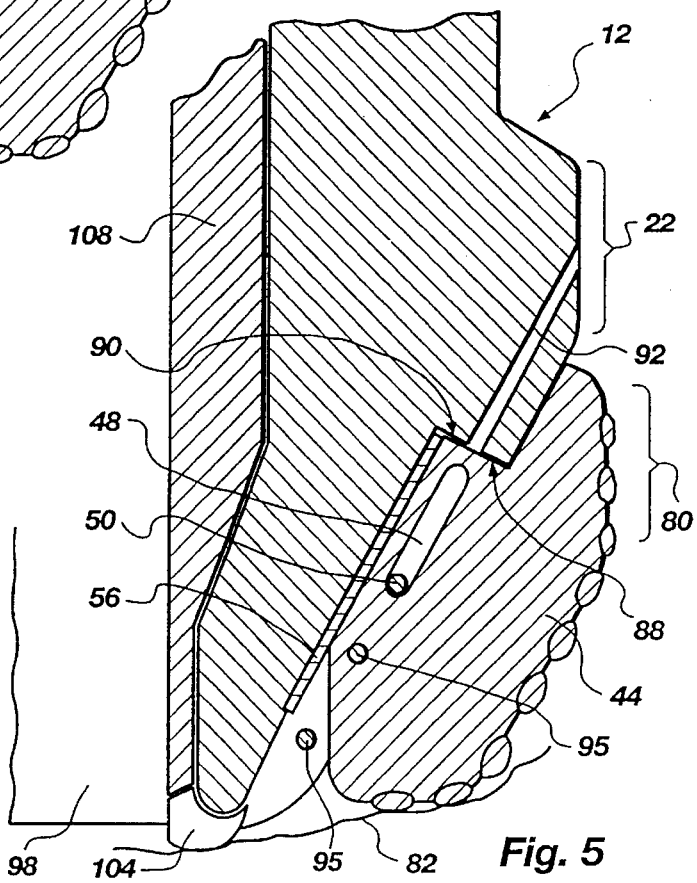
FIG. 5 is a partial view of a core bit in cross section illustrating the cutting means in the second position.

It should also be understood that a blade retention means, such as shear pins, biasing springs, spring-biased ball detents, magnets, leaf drag springs or other means known in the art, may be employed to assist in retaining blades 40, 42 and 44 in a retracted position until it is desired to expand them. FIG. 4 depicts a modification employing a coil-type biasing spring 93. FIG. 5 depicts a modification employing a shear pin 95 which has been severed as blade 44 extends. However, such features are not absolutely essential to the basic concept of the invention.

Due to hydrostatic pressure of the drilling fluid in the wellbore, there will normally be an accumulation of fluid which has seeped into the channel 36 and which may impede free upward movement of the blades 40, 42 and 44. Therefore, relief apertures 92, shown in FIGS. 4 and 5 with respect to column 30 and blade 44, may be formed through the bit body 12 or the columns 26, 28 and 30 to provide communication of fluid therethrough from the channels 36 to outside the bit body 12.

When the blades 40, 42, 44 are urged upwardly, the circumference 78' defined by the outer gage 80 of the blades 40, 42, 44 during rotation of bit 10 becomes greater than the circumference 24 of the outer body diameter 22 of the drill bit 10, as illustrated by FIGS. 3 and 5. Rotation of the drill bit 10 during drilling therefore results in a hole being drilled of a gage or diameter which is greater in diameter than the outer body diameter 22 of the body 12 of drill bit 10. It can be readily understood, therefore, that when drilling ceases and the drill bit 10 is tripped out of the hole, the blades 40, 42, 44 slide downwardly and radially inwardly, as shown in FIG. 1, assuming a smaller circumference 78 so that the drill bit 10 can be easily removed from the hole.

The principles of the present invention are applicable to well drilling operations as well as core drilling operations. More specifically, in well drilling operations, the objective is to drill a hole into the earth to access underground reserves of minerals or fluids such as oil. In well drilling operations, therefore, it is necessary to provide cutting means which act upon the center of the very bottom as well as the radially outer area of the bottom of the hole in the drilling thereof. Thus, when used in well drilling operations, the present invention includes a secondary cutting means 94, illustrated in FIG. 6, positioned at the nose 32 of the drill bit 10. The secondary cutting means 94 has cutting elements 96 associated therewith which, in conjunction with the cutting elements 66 positioned on the lower edges 72, 74, 76 of the blades 40, 42, 44, act upon the bottom-most surface of the hole.

Figure 6:
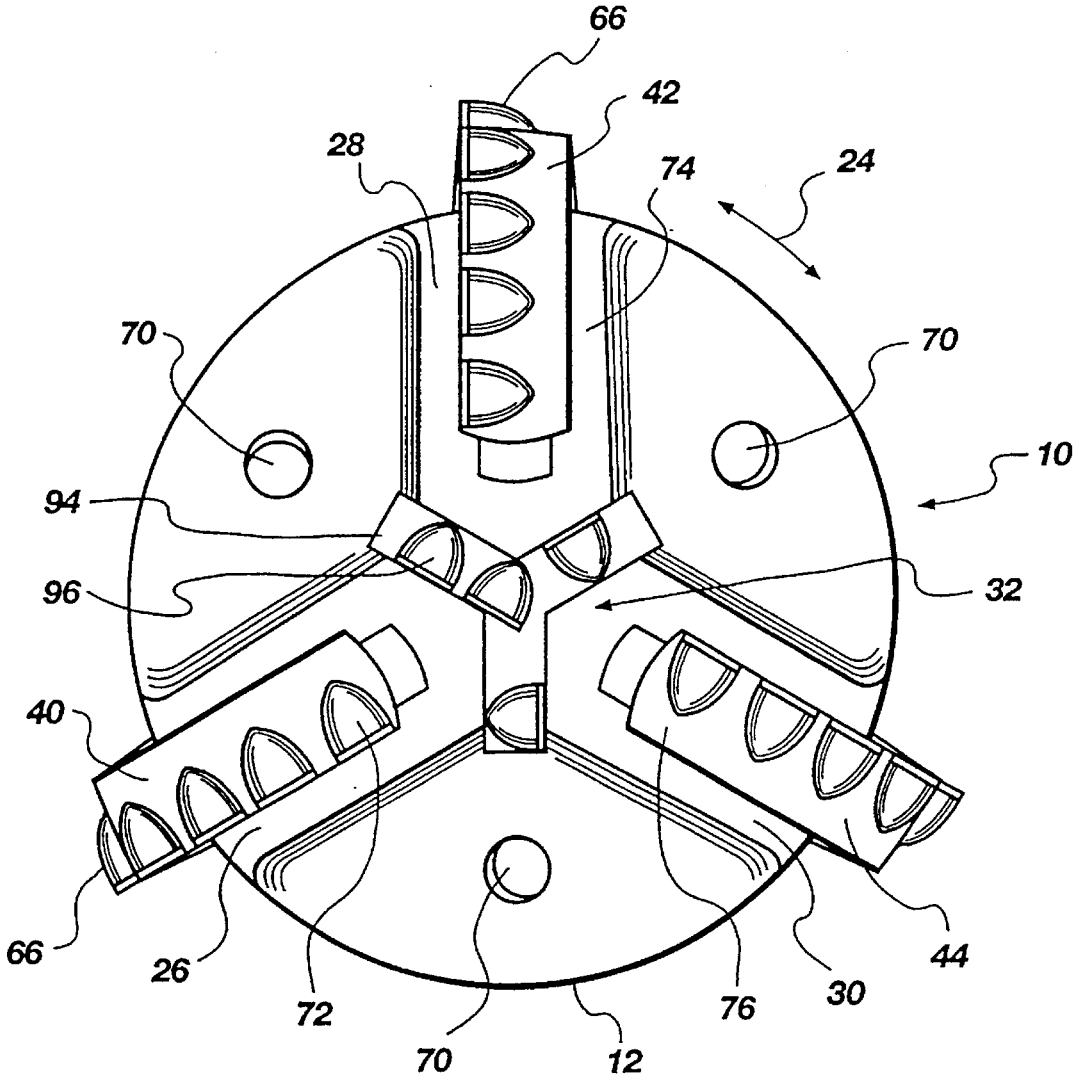
FIG. 6 is a plan view of the bottom of a drill bit of the present invention used in well drilling depicting both cutters fixed directly to the bit body and cutters fixed to movable portions of the bit crown.

The secondary cutting means 94 may take any shape or form which provides suitable cutting action against the bottom of the hole but which does not obstruct movement of the blades 40, 42, 44 when they are drawn downwardly, such as when being tripped in and out of the hole. An exemplary configuration of the secondary cutting means 94 is illustrated in FIG. 6. Notably, the blades 40, 42, 44 in FIG. 6 are shown in the second, expanded position pushed outwardly relative to the body 12 of the drill bit 10. However, when the drill bit 10 is being tripped in or out of the hole, the blades 40, 42, 44 converge downwardly toward the secondary cutting means 94 and the secondary cutting means 94 does not impair the movement of the blades 40, 42, 44. Apertures or nozzles 70, which direct drilling fluid downwardly toward the blades 40, 42, 44 during drilling, may also be oriented to remove debris from the secondary cutting means 94.

The principles of the present invention may also be used in connection with drilling apparatus used for drilling cores. Such apparatus typically comprises a drill bit connected to a core barrel which is structured with an inner tube for receiving and retaining a core of earth cut by the drill bit. Drill bits used in core drilling are structured with a central aperture 98 formed in the nose 32 of the drill bit 10, as illustrated in FIGS. 4, 5 and 7.

Figure 7:
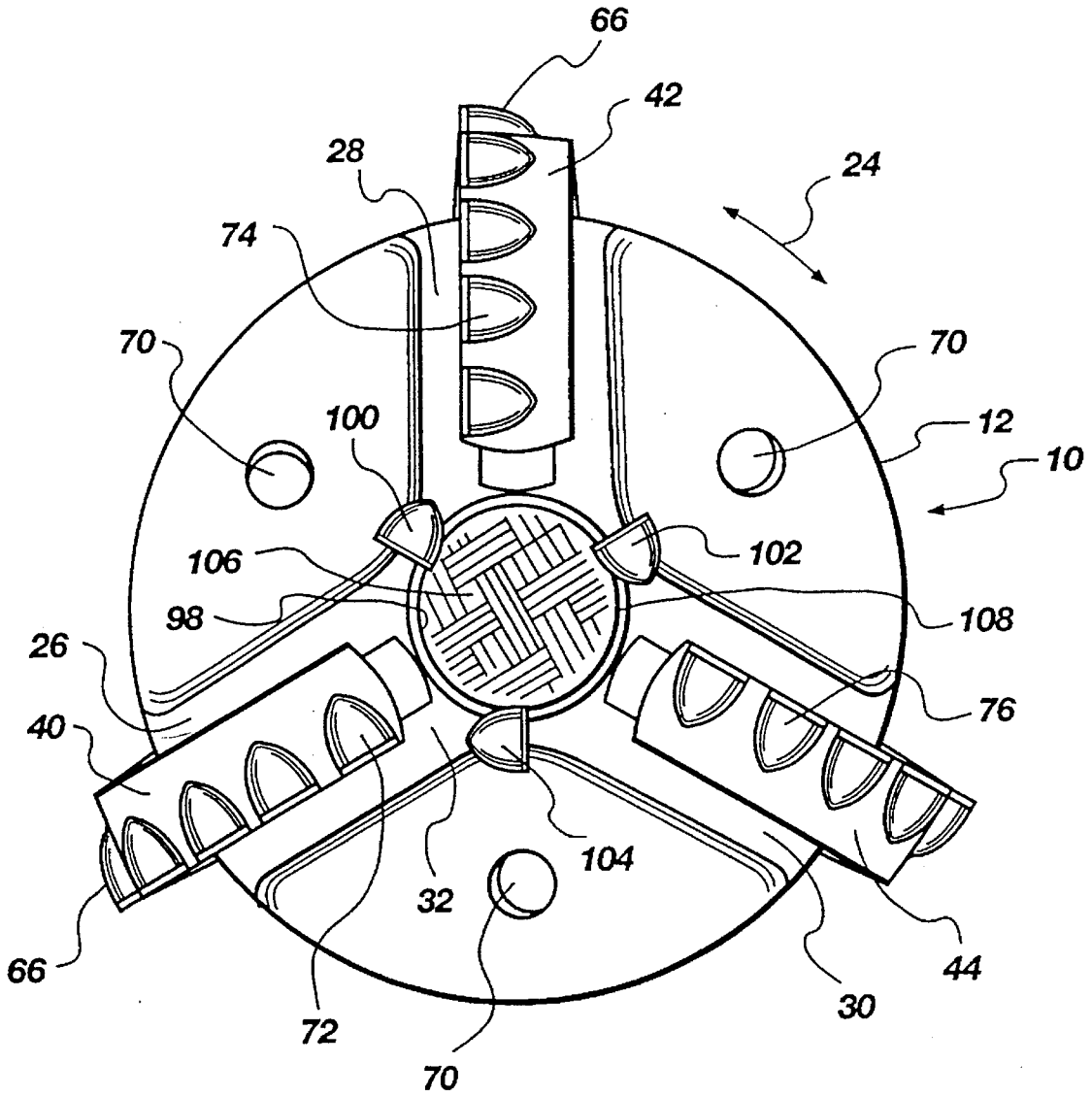
FIG. 7 is a plan view of the bottom of the core bit illustrated in FIGS. 4 and 5.

When a drill bit 10 according to the present invention is used in core drilling, the blades 40, 42, 44 are urged outwardly when the lower edges 72, 74, 76 contact the bottom of the hole, as illustrated by FIGS. 5 and 7. When used in core drilling, the bit body 12 also has core cutter elements 100, 102, 104 which are located radially inwardly of the position of lower edges 72, 74, 76 of blades 40, 42, 44 during coring and which cut in a circular pattern, thereby excising a core 106 which moves into the shoe 108, shown in FIGS. 4 and 5, as drilling progresses further down the hole.

Figure 8:
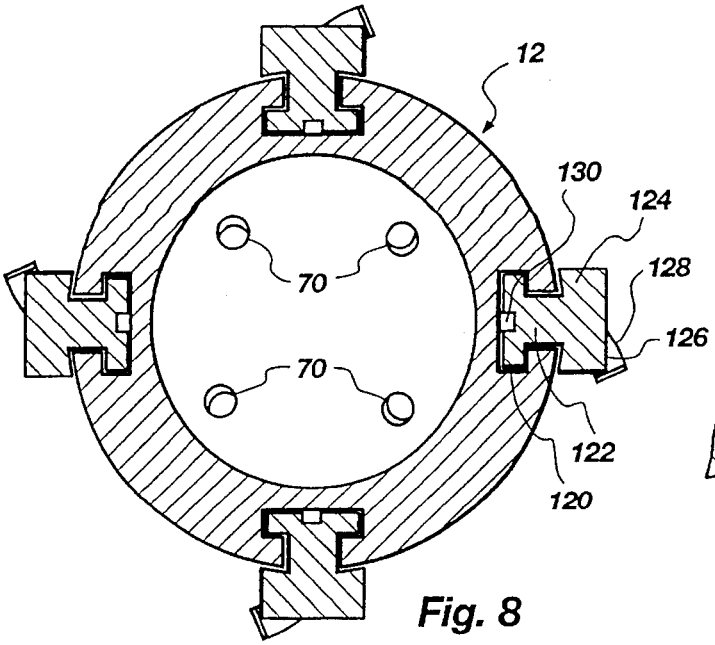
FIG. 8 is a lateral, cross-sectional view of a second preferred embodiment of the present invention.
Figure 10A:
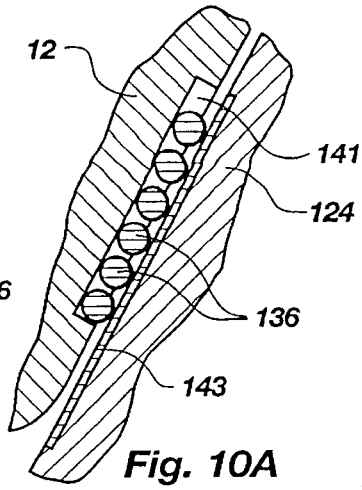
FIG. 10A is a longitudinal, cross-sectional view of an alternative bearing structure employed in the present invention.
Figure 10:
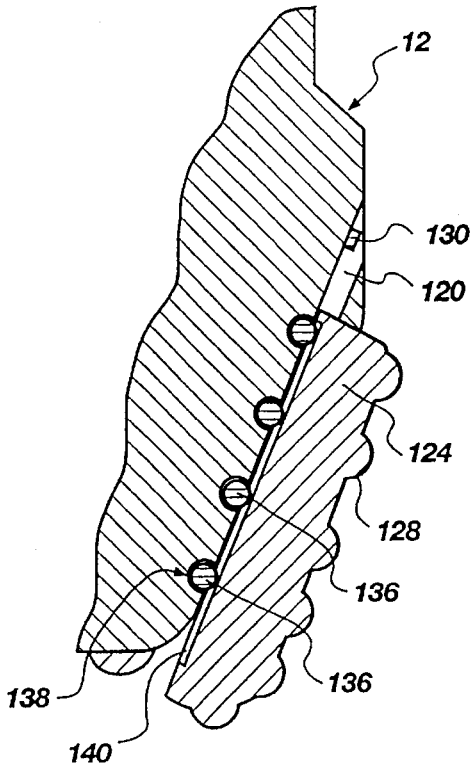
FIG. 10 is a longitudinal, cross-sectional view of the embodiment shown in FIG. 9.
Figure 9:
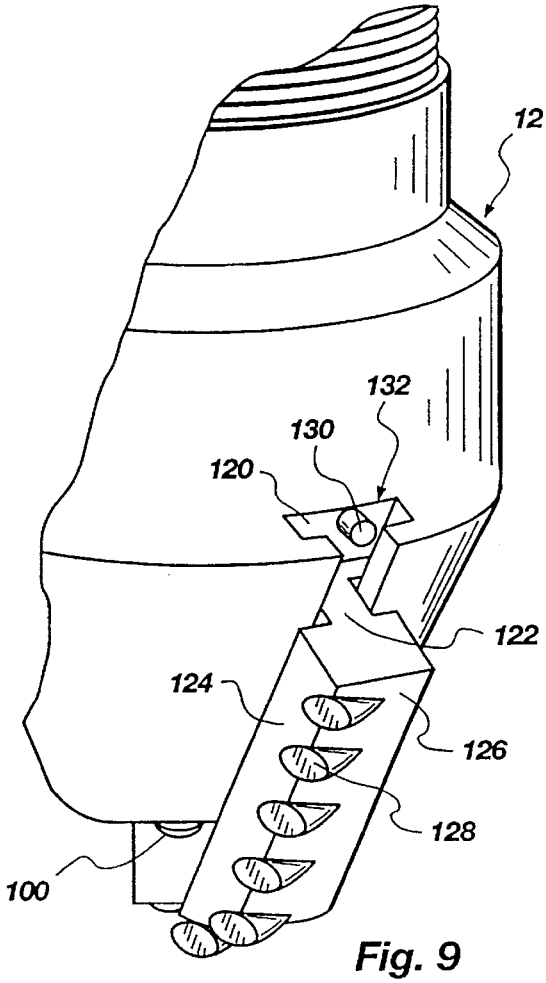
FIG. 9 is a side elevational view of the embodiment shown in FIG. 8.

In another embodiment of the present invention, as illustrated by FIGS. 8, 9 and 10, the bit body 12 may have T-shaped channels 120 formed therein and sized to receive a reciprocating T-shaped member 122 of a blade 124. As illustrated by FIG. 8, there may be a plurality of blades 124, numbering from two to twelve or more for extremely large bits. Secured to the outer face 126 of the blade 124 is a plurality of cutting means 128 for drilling the formation. In this embodiment, the T-shaped channel 120 may have intervention or stop means 130 associated with the upper end 132 thereof to limit the upward movement of the blade. The blade 124 is thereby prevented from exiting the T-shaped channel 120 completely.

As shown by FIG. 10, the movement of the blades 124 in the T-shaped channel 120 may be facilitated by bearing means, shown here as balls 136 cradled in sockets 138 positioned in the bit body 12. The balls 136 may roll within a race 140 formed in the blade 124. When balls 136 are used as the bearing means, there may be a single ball or a plurality of balls 136 as shown in FIG. 10. Moreover, as shown in FIG. 10A, balls 136 may be contained within a recess 141 in bit body 12 and roll on a bearing surface 143 on the blades 124.

Figure 11:
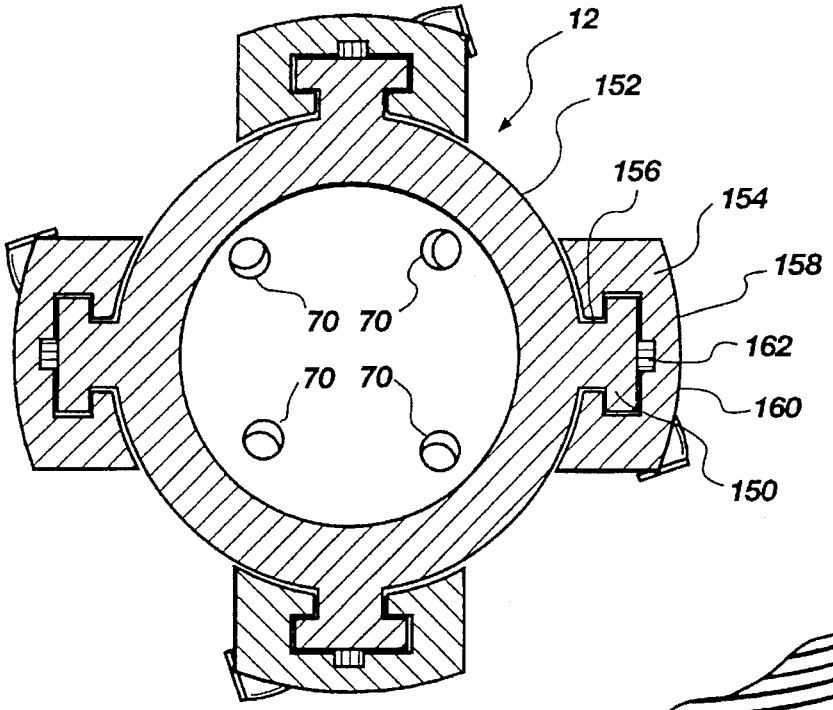
FIG. 11 is a lateral, cross-sectional view of a third preferred embodiment of the present invention.
Figure 12:
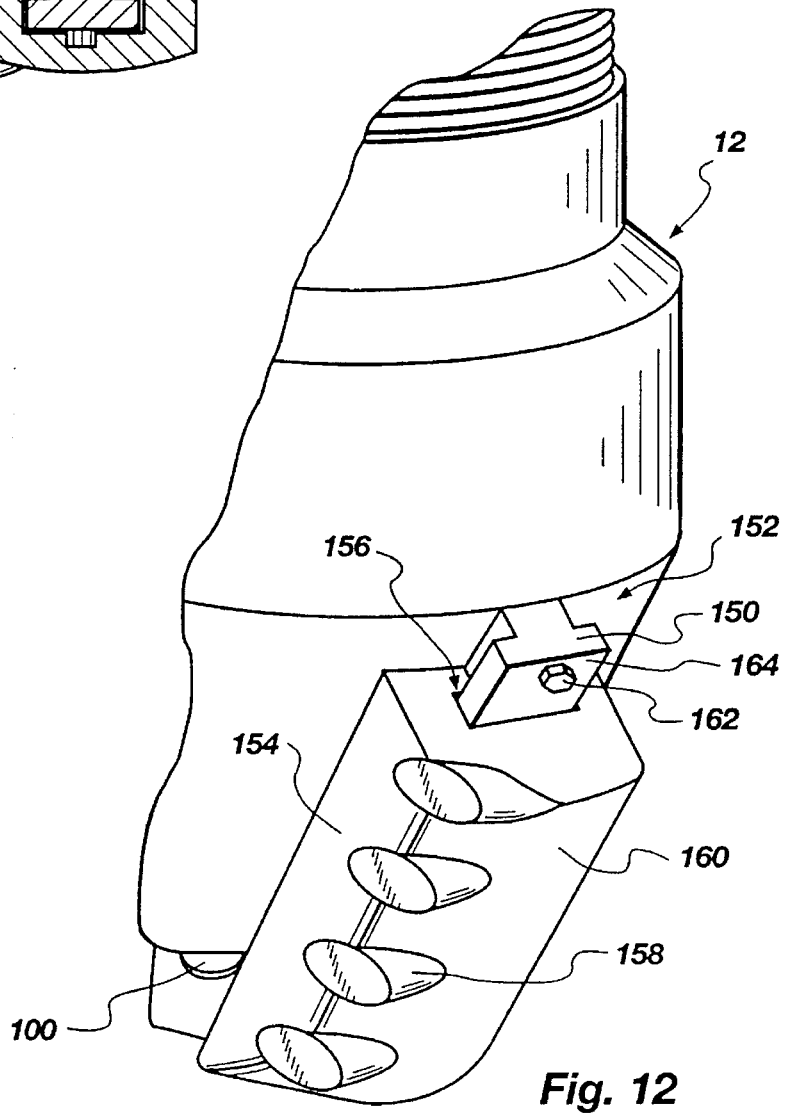
FIG. 12 is a side-elevational view of the embodiment shown in FIG. 11.

In yet another embodiment, as shown by FIGS. 11 and 12, T-shaped rails 150 may be formed on the outer face 152 of the bit body 12. The blades 154 may be configured with a T-shaped channel 156 which is sized to slidably interconnect with the T-shaped rails 150 on the bit body 12. Cutting means 158 are secured to the outer face 160 of the blades 154 for drilling the formation. Intervention or stop means 162, shown in FIG. 12 as a bolt, may be associated with the upper end 164 of the T-shaped rail 150 to limit the upward movement of the blade 154 on the bracket 150.

Figure 13:
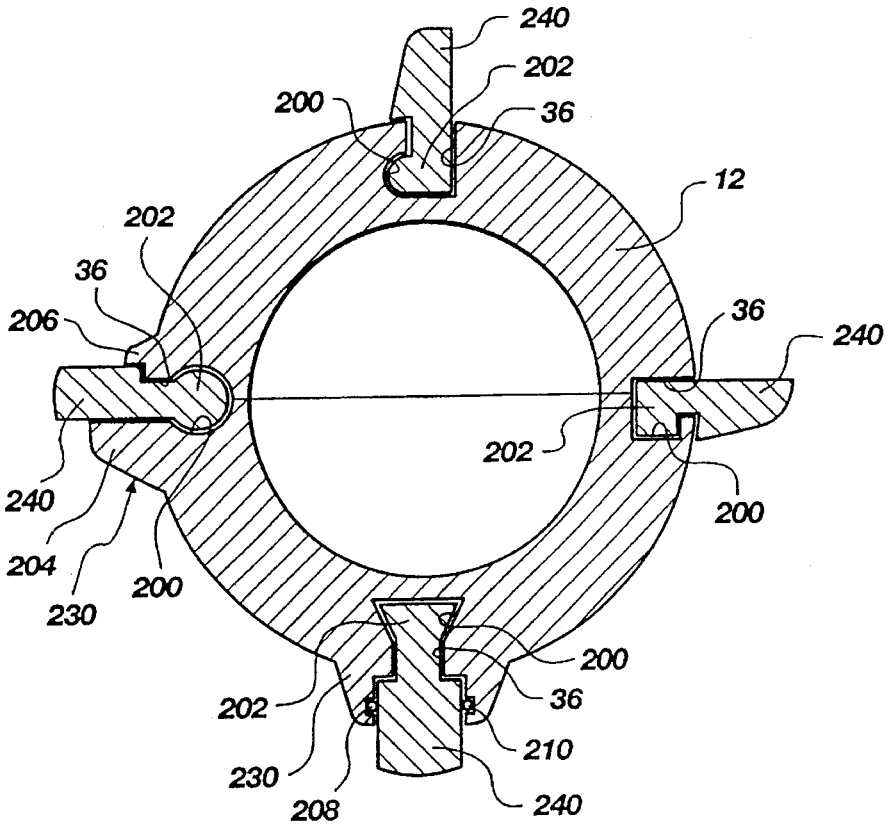
FIG. 13 is a lateral, cross-sectional view of a fourth preferred embodiment of the present invention.
Figure 14:
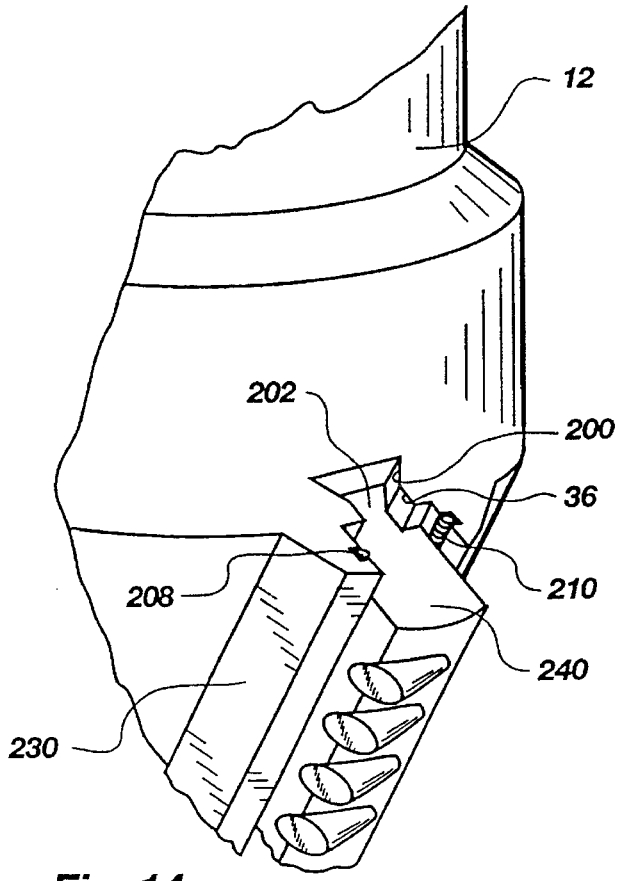
FIG. 14 is a side-elevational view of the embodiment shown in FIG. 13.

Referring to FIGS. 13 and 14, yet another embodiment of the present invention is illustrated. In this embodiment, bit body 12 includes channels 36 which are enlarged at their bases 200 to receive a cooperating enlarged protrusion 202 along the inner extent of blades 240. The cross-sectional configuration for enlarged channel bases 200 and cooperating enlarged protrusions 202 may be of a dovetail cross section or circular, half-circular, rectangular or any other suitable configuration to provide blade retention, as shown for exemplary purposes in cross section in FIG. 13. Such a design eliminates the need for any dedicated bearing structures, although, of course, teflon coatings or brass or other inserts may be used to facilitate blade movement. A pin and slot configuration, as disclosed with respect to the embodiment of FIG. 1, or a stop means, as shown in FIG. 9, may be employed to limit outward travel of blades 240 and thus define the gage of the wellbore being drilled.

FIG. 13 also illustrates that the back or trailing side 204 of a column 230 containing a blade 240 may extend radially outwardly farther than the leading side 206 to provide support for the blades against circumferentially or tangentially directed forces caused by rotation of the drilling string and contact with the formation. It should also be noted, as illustrated in FIGS. 13 and 14, that channels 36 may reside in the bit body 12 itself, columns 230 not being required for all applications.

Finally, FIGS. 13 and 14 also show the use of seals 208 and/or 210 between the blades and the inner surfaces of the channels in which they move.

Figure 16:
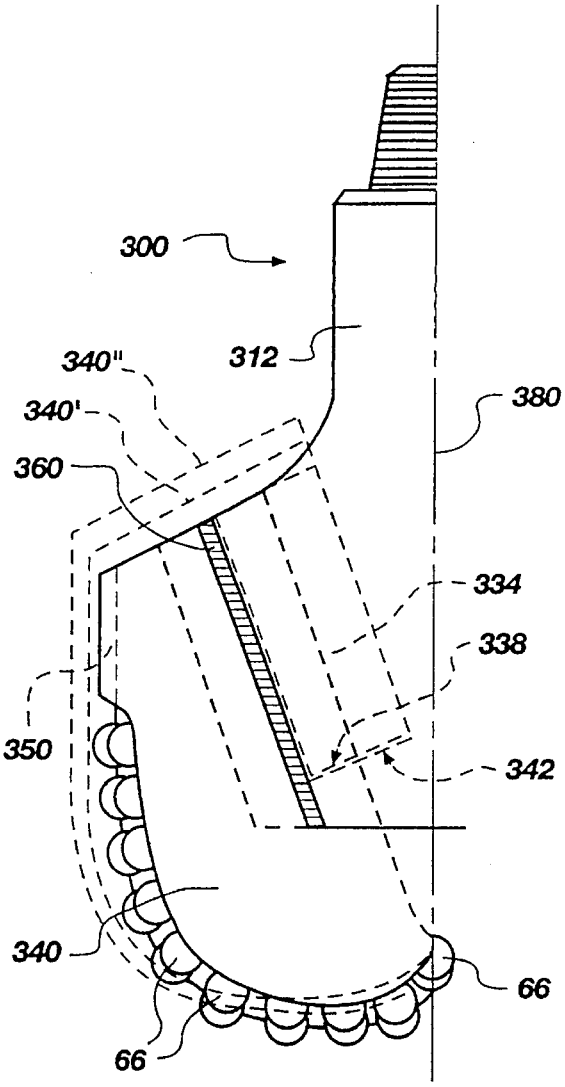
FIG. 16 is a side-elevational view of the drill bit of FIG. 15.
Figure 15:
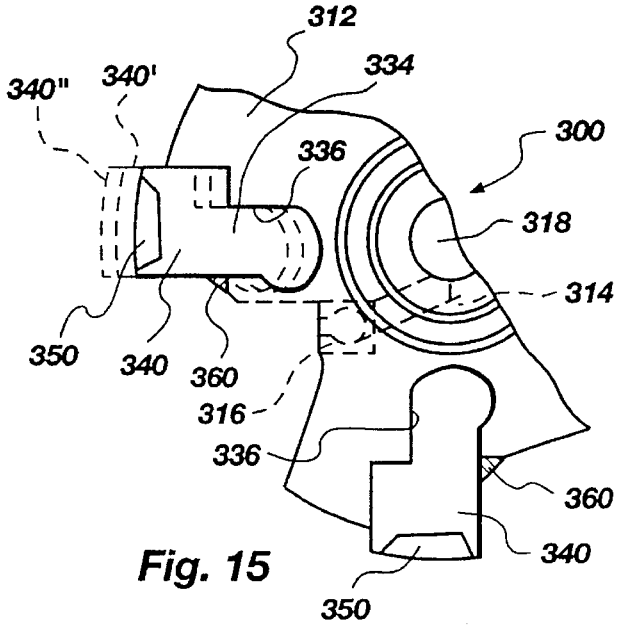
FIG. 15 is a partial, lateral, cross-sectional view (looking upwardly) of a drill bit having a fixed, replaceable cutter support structure according to the present invention.

The embodiment of FIGS. 15 and 16 illustrates how the principle of the present invention may also be used to enhance the characteristics of a fixed-blade bit. Bit 300 includes channels 336 in body 312. Hydraulic passages 314 terminating in nozzles 316 are also formed in body 312. Passages 314 communicate with bore 318 of body 312 to receive drilling fluid therefrom.

Blades or wings 340 comprising cutter support structures are fabricated separately from body 312 and include inner portions which may be termed blade keys 334, which blade keys 334 slide into channels 336 where they are secured by welding, brazing, adhesive bonding or mechanical securement means known in the art such as bolts, screws, pins or keys. Alternatively, body 312 may be heated, blades 340 dropped into channels 336, and body 312 cooled, resulting in shrinkage of body 312 and retention of blades 340 therein. With such an arrangement, damage or wear to a particular blade or cutting elements thereon may be addressed by removal of the damaged blade, repair thereof and reinsertion in body 312 or, if the blade is irreparably damaged, by replacement with a new one. Gage pads 350 as well as cutting elements 66 constitute replaceable elements on blades 340.

As shown in FIGS. 15 and 16 by way of example, blades 340 may be secured in body 3 12 by weld beads 360. Downward movement of blades 340 in channels 336 is arrested by contact of the lower end 342 of each blade key 334 with shoulder 338 in a channel 336. It should be noted that the inner portion of blade key 334 and those of channel 336 are of larger cross section than the intermediate portions, as in the other embodiments of the present invention, to maintain blades 340 within channels 336.

Blades 340 would normally not be identical, in that one channel 336 and cooperating blade 340 are extended so that the cutting elements 66 of that blade 340 cut the very center of the wellbore, as shown in FIG. 16, the centerline or axis of bit 312 being designated as 380. Alternatively, a group of cutters may be mounted directly on the nose of the bit to cut the center of the wellbore (see FIG. 6 for such a grouping). With such a design, all of the blades 340 may be made identical, it being understood that even with identical blade size and configuration, the number and location of the cutters 66 of the blades 340 may or may not differ for optimum performance.

Figure 16A:
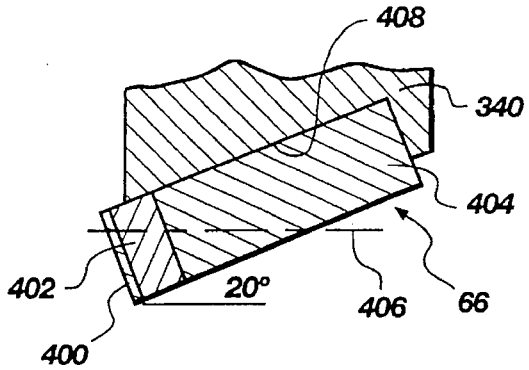
FIG. 16A is an enlarged section of a cutting element as mounted in one of the cutter support structures of the bit of FIGS. 15 and 16.

FIG. 16A depicts an exemplary cutting element 66 usable with drill bit 300. Cutting element 66 includes a layer 400 of diamond or other superhard material formed on a metallic substrate 402 (typically WC) and secured to cylindrical carrier element 404 of sufficient length to provide adequate surface area for brazing or otherwise bonding element 66 to blade 340. Further, as shown in FIG. 16A, the length of carrier element 404 provides continued bond strength throughout the wear life of cutting element 66, until roughly 75% of diamond layer 402 is worn away, shown at line 406 for element 400, disposed at a 20° angle to the axis or centerline 380 of bit 300.

It may also be readily appreciated from perusal of FIGS. 15 and 16 that the present invention as applied in those figures permits an entire size or gage range of bits to be fabricated from a single body size 312 by utilizing different size blades 340. In such a manner, odd-gage sizes may be easily accommodated without inventorying entire bits. Even more preferably, a single size of blades 340 may be employed within a given gage size range and the blades 340 positioned selectively in channels 336 before affixation therein, the upward or downward change in position effecting a change in gage size (see 340' and 340") while using the same blade. In such a manner, a six-inch range of bits might be fabricated to extend from a 5⅞-inch gage size to a 6¾-inch gage size, or an eight-inch range of bits might be fabricated to extend from a 7⅞-inch gage size to a 8¾-inch gage size.

A further advantage of the embodiment of FIGS. 15 and 16 is the ability to fabricate otherwise identical blades 340 with different sizes, types and densities (light-set versus heavy-set with cutters) of cutting elements 66 to accommodate different formative types. Thus, a particular size bit (for example, 6¾ inch) may be fabricated to optimally cut a hard, medium or soft formation, or a formation with or without hard stringers interspersed in a softer rock. Preferred cutter back rakes and side rakes can also be accommodated by using interchangeable blades 340 with a common body design such as body 312.

The use of separately-fabricated cutter support structures, shown as blades 340 but which also may be termed "ribs" or "pads," depending upon the bit design in which such structures are employed, offers other advantages in addition to those previously set forth. For example, whether the bit body 312 is of tungsten carbide matrix, steel or other construction, a body according to the present invention is much simpler and therefore less expensive to manufacture in comparison to conventional drag bits. Complex cutter positioning and mounting problems are removed from the bit body to be dealt with on the much simpler, more two-dimensional and planar structure of blades, ribs or pads 340. The present invention may even permit the casting of bit bodies from molten metal, such as steel, by overcoming the problems of precise cutter placement due to shrinkage and distortion of the casting.

The blades, ribs or pads 340, being smaller and much less complex than the bit body 312, can be easily produced to much smaller tolerances, with excellent repeatability through numerically controlled (N/C) tooling. Blades, ribs or pads 340 may be accurately machined from ductile metal or formed in the manner of a matrix-type bit from extremely accurately-machined molds. The smaller part size for matrix fabrication also significantly reduces total furnacing time in comparison to a conventional one-piece bit, as well as the potential for shrinkage and cracking of the part.

The use of separately-fabricated cutter support structures also promotes the precise location and orientation of cutting elements 66, as well as enhancing the quality of the bond between cutting elements 66 and body 312 via blade, rib or pad 340. For example, the same above-enumerated advantages which permit the production of a precisely-dimensioned blade 340 also permit the cutter pockets or sockets 408 to be precisely placed, dimensioned and oriented as desired, all of the cutters on a single blade being placed essentially on the same plane as defined by the blade. Again, whether the blade is a matrix structure or ductile metal, the small size and simple, two-dimensioned configuration of the part facilitates precise machining operations. Once the blade, rib or pad 340 has been fabricated with cutter pockets 408 to receive PDC cylinder-type cutters 66, such as those illustrated in FIG. 16A or others as known in the art, such as so-called "stud" cutters, the actual securement of the cutters is enhanced by being able to place all of the cutters 66 in the pockets and then furnace-braze the cutters at the same time to the blade, rib or pad 340 with a number of other such structures being completed in the same furnace. This technique is in contrast to a conventional brazing technique wherein PDC cutters are brazed to a bit face one at a time. An alternative method of brazing which would permit higher braze temperatures and thus the use of stronger brazes while maintaining the PDC cutter diamond tables at a reasonably low temperature would be the use of a heating system under horizontally-oriented blades, ribs or pads 340 with the cutters 66 supported in the cutter pockets 408 by gravity. The diamond tables are then contacted by a cooling system above the blade to maintain a desirable, non-damaging temperature.

If it is desired to mechanically secure cutters 66 to a blade, rib or pad 340, again the simpler shape of the structure 340 can facilitate the use of mechanical attachment means, which may even extend all the way through the cutter support structure.

It is also contemplated that an impregnated-type bit is especially adaptable to this design, as the blades, ribs or pads 340 may be easily formed in whole or in part by sintering or hot isostatic pressing to include diamond or other abrasive particles, such as cubic boron nitride. If smaller impregnated cutter segments are employed, the segments may then be placed in a mold to be bonded in a tungsten carbide matrix, or in another castable material.

Assembly of the blades, ribs or pads 340 with the body 312 is relatively simple, as previously alluded. Whether structures 340 are welded to a body 312, brazed, adhesively bonded or mechanically secured, the alignment and position of all of the assembled components of the finished bit 300 can be checked for accuracy and the jig or other fixture holding the assembly adjusted accordingly before the formal securing step is taken. If it is found that a supporting structure 340 is out of tolerance, or a cutter 66 is damaged, out of position or misoriented, that structure can be replaced quickly and easily.

Figure 19:
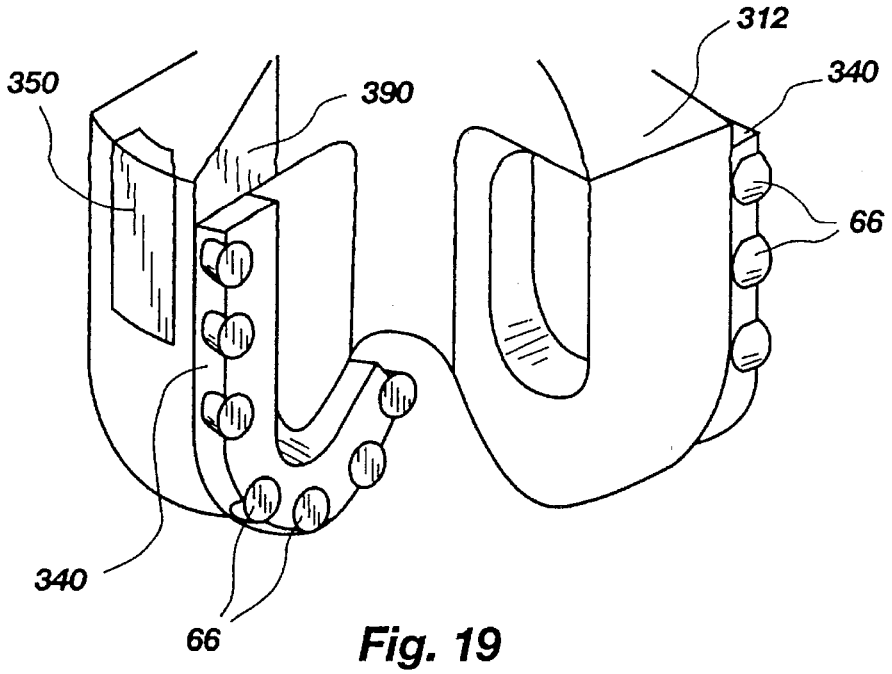
FIGS. 18 and 19 are perspective views of bit body portions and associated separately-fabricated cutter support structures.
Figure 18:
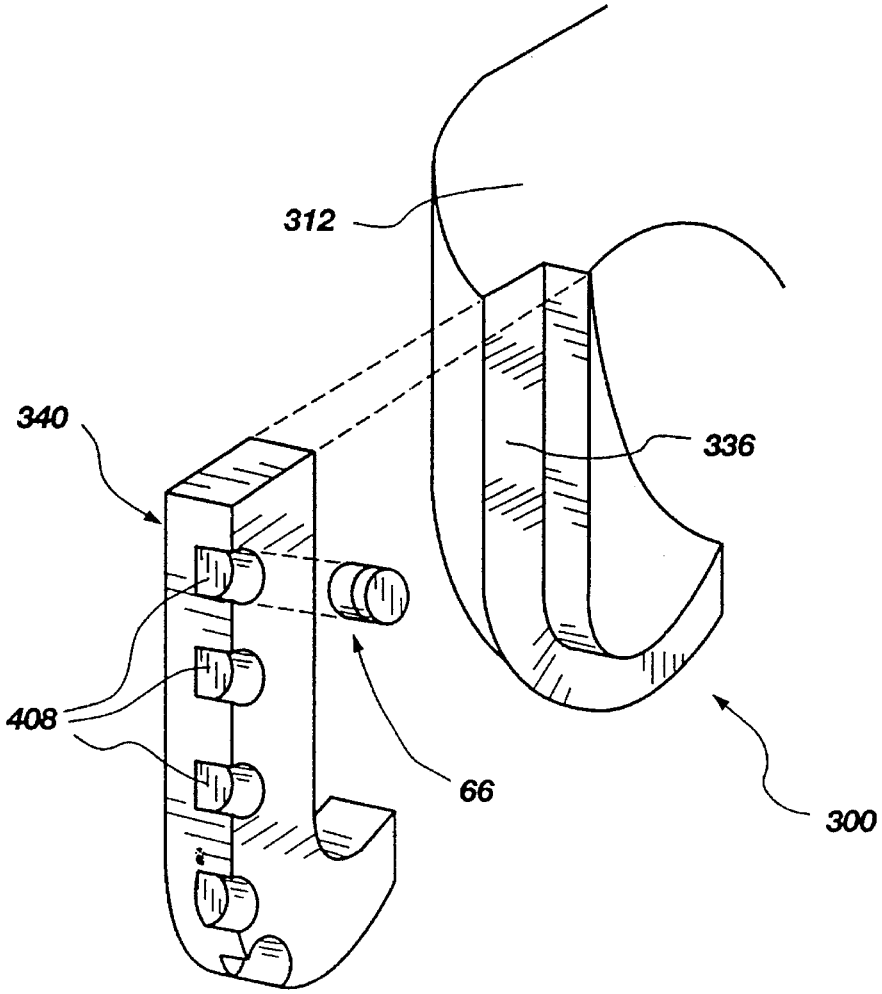

As can be seen from FIGS. 18 and 19, supporting structures 340 may be cast into shapes which interlock with a non-linear channel 336 in a body 312 (FIG. 18) or which are secured (such as by a braze, weld, adhesive or by mechanical means) to an exterior surface 390 of a body structure as shown in FIG. 19.

Figure 20:
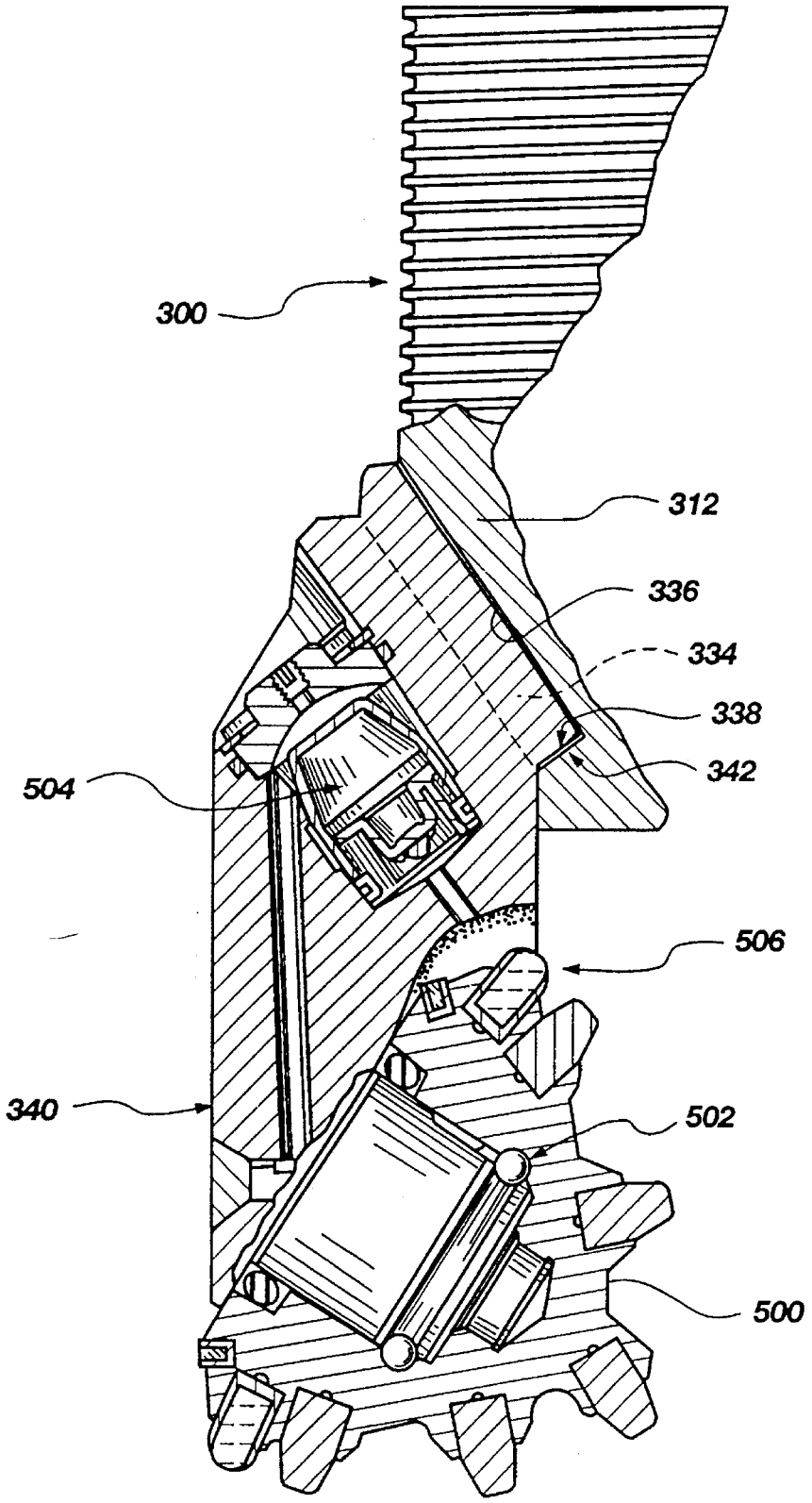
FIG. 20 is a partial, sectional, side elevation of a roller cone cutter embodiment of the invention.

FIG. 20 illustrates yet another adaptation of the present invention, wherein body 312 of drill bit 300 is configured with channels 336 to receive matching key portions 334 of cutter support structures 340, each of which carry a roller cone cutter 500 with associated bearing structures 502 and lubrication structure 504, together comprising cone assembly 506. With such an arrangement, fabrication of a roller cone bit is facilitated, and easy replacement of entire cone assemblies 506 is possible, thus speeding up repair time in the event of damage to one assembly of the three normally on such a bit. In addition, bit bodies 312 may remain unassembled with cutter support structures 340 until an order is received, at which time the appropriate cutter support structures 340 with the proper cone assemblies 506 for the formation to be drilled can be attached to a body 312. For example, a mill-tooth, tungsten carbide insert or diamond insert cone cutter 500 may be selected, as appropriate, or a cone cutter 500 with a particular tooth or insert length configuration or arrangement selected.

As well as providing greater flexibility and ease of fabrication, it is also anticipated that in certain instances roller cone bits may be fabricated according to the present invention wherein one of the cutter support structures is retractable either linearly as previously discussed or rotationally as subsequently noted herein with respect to the embodiment of FIG. 17. Thus, a roller cone bit may be fabricated which can negotiate tight boreholes or doglegs in a relatively expeditious manner. Retraction and expansion may be effected, respectively, by gravity and contact with the bottom of the borehole or may be controlled by biasing means or a hydraulic system.

Figure 17:
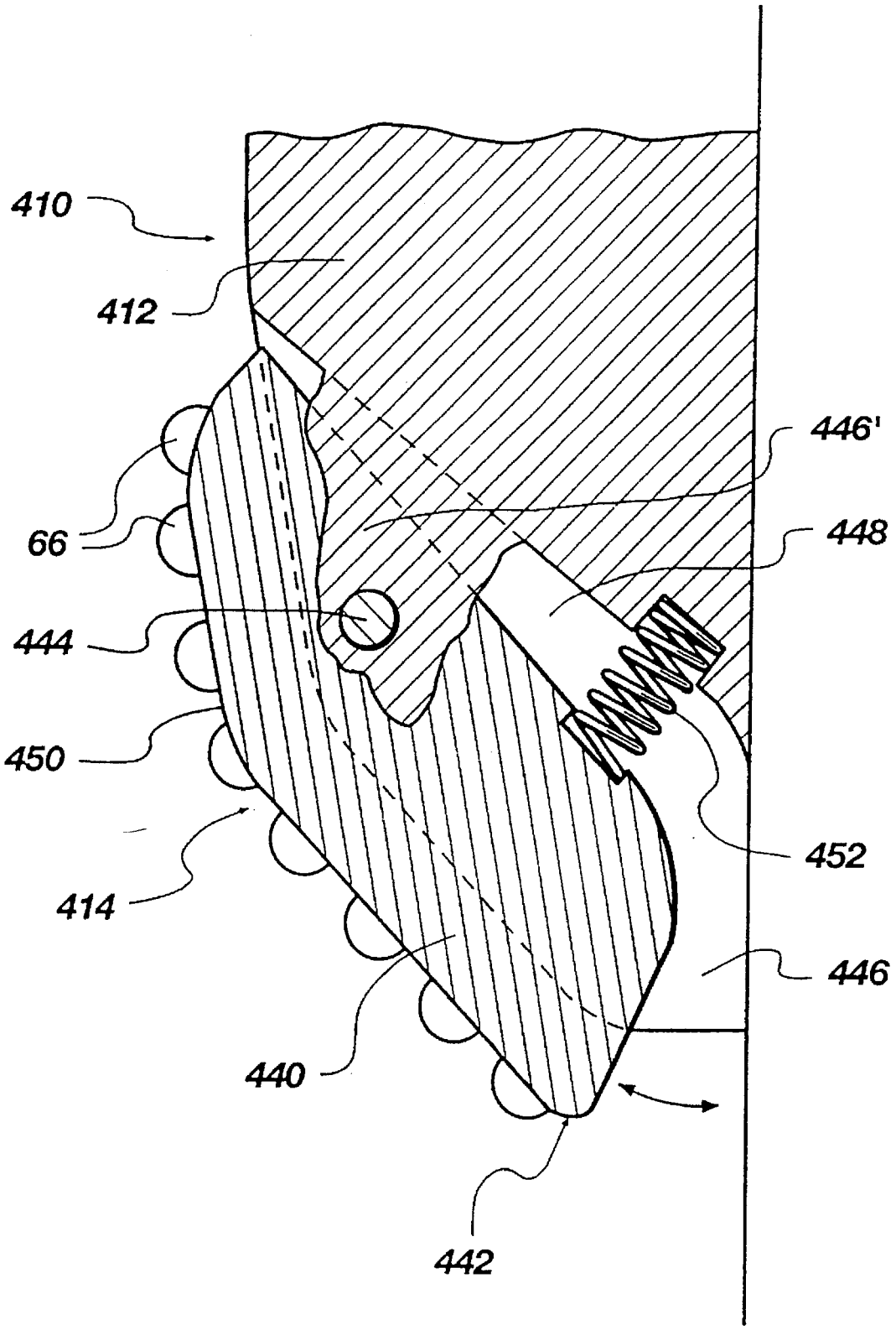
FIG. 17 is an enlarged, partial, quarter-sectional view of a rotationally-expandable gage drill bit according to the present invention.

In addition to the previously disclosed embodiments of the invention, it is also contemplated that the cutting means 414 of a drill bit 410 of the present invention may be rotationally expandable from a first retracted position to a second expanded position responsive to contact with the undrilled bottom of the hole, as depicted in FIG. 17. In this embodiment, one or more blades 440 having a leading edge 442 may each be rotatable about a hinge pin 444 which is secured to body 412 at walls 446 and 446' which define a blade recess 448. Upon contact of leading edge 442 with the bottom of the hole, trailing edge 450 of blade 440 will rotate outwardly to an expanded position whereat cutting elements 66 will engage the formation and bit 410 will cut an enlarged borehole upon rotation of bit 410. Upon withdrawal of drill bit 410 from the hole bottom, blade 440 will retract, the retraction being augmented if desired by a biasing means such as spring 452. Alternatively, a hydraulic mechanism may be employed to assist blade withdrawal.

The movable cutting means of the present invention allow the drill bit to be easily tripped in and out of a hole without becoming lodged or jammed downhole. The drill bit of the present invention is thus adaptable to any drilling apparatus and is usable with any kind of drilling technique. Moreover, the discrete body/insertable blade configuration of the present invention is adaptable to an easily repairable, fixed-blade drill bit. Further, the drill bit of the present invention is susceptible to use in so-called "anti-whirl" bit designs. Finally, it should be recognized and appreciated that the use of a single movable or retractable blade rather than the multiple retractable blades of the preferred embodiments is contemplated as within the scope of the invention. Such a bit, with a simple movable blade, would be particularly suited to provide the directed side force required for an anti-whirl bit. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A variable gage size drill bit for drilling subterranean formations, comprising:

a body including at least one substantially radially-oriented channel opening onto the exterior thereof;

at least one blade carrying cutting structure thereon and having a portion received within and substantially radially inwardly and outwardly slidable within said at least one channel to define a gage size for said bit within a range of gage sizes corresponding to a range of travel of said at least one blade portion within said at least one channel; and structure for securing said at least one blade received within said at least one channel in fixed relationship to said body at a location within said range of travel to define said gage diameter.

2. The drill bit of claim 1, wherein said structure for securing is adapted to permit selective removal of said at least one blade from said body.

3. The drill bit of claim 1, wherein said cutting structure include diamond cutters.

4. The drill bit of claim 1, wherein said at least one blade carries a replaceable gage pad thereon.

5. The drill bit of claim 1, wherein at least one of said cutting structure is carried in a pocket on said at least one blade.

6. The drill bit of claim 1, wherein said cutting structure comprises a rotatable roller cone cutter.

7. A drill bit for drilling subterranean formations, comprising:

a body having a structure for engaging a separately-fabricated cutter support structure within a range of generally radial travel; and at least one separately-fabricated cutter support structure carrying a plurality of cutters on the exterior thereof secured in a fixed position to said body within said range of travel.

8. The drill bit of claim 7, wherein said engaging structure of said body comprises a generally radially extending channel.

9. The drill bit of claim 7, wherein said engaging structure comprises a surface on the exterior of said body.

10. The drill bit of claim 9, wherein said surface comprises a flat surface.

11. The drill bit of claim 7, wherein said at least one cutter support structure is configured as a blade.

12. The drill bit of claim 7, wherein said at least one cutter support structure is configured as a rib.

13. The drill bit of claim 7, wherein said at least one cutter support structure is configured as a pad.

14. The drill bit of claim 7, wherein said body comprises a tungsten carbide matrix, and said at least one cutter support structure is formed of a ductile metal.

15. The drill bit of claim 7, wherein said body is formed of a ductile metal and said at least one cutting structure comprises a tungsten carbide matrix.

16. The drill bit of claim 7, wherein said plurality of cutters are received in preformed pockets in said at least one cutter support structure.

17. The drill bit of claim 16, wherein said pockets are machined in said at least one cutter support structure.

18. The drill bit of claim 16, wherein said pockets are formed in said at least one cutter support structure during formation of the latter.

19. The drill bit of claim 7, wherein said plurality of cutters are disposed on a rotatable roller cone.

* * * * *